United States Patent [19]

Simon

[11] 4,435,972

[45] Mar. 13, 1984

[54] PROCESS FOR FORMING INTEGRAL SPINDLE-AXLE TUBES

[76] Inventor: Joseph A. Simon, 17755 Masonic Blvd., Fraser, Mich. 48026

[21] Appl. No.: 393,032

[22] Filed: Jun. 28, 1982

[51] Int. Cl.[3] ..... B21C 25/08; B21C 37/16

[52] U.S. Cl. ..... 72/256; 72/260; 72/266; 72/367; 72/370

[58] Field of Search ..... 72/256, 260, 266, 367, 72/370, 267

[56] References Cited

U.S. PATENT DOCUMENTS

| | | | |
|---|---|---|---|
| 3,837,205 | 9/1974 | Simon | 72/370 |
| 3,927,449 | 12/1975 | Gibble et al. | 72/267 |
| 4,100,781 | 7/1978 | Zawacki et al. | 72/370 |
| 4,301,672 | 11/1981 | Simon | 72/370 |

FOREIGN PATENT DOCUMENTS

| | | | |
|---|---|---|---|
| 217564 | 9/1957 | Australia | 72/367 |
| 928929 | 6/1955 | Fed. Rep. of Germany | 72/367 |

*Primary Examiner*—Lowell A. Larson

*Attorney, Agent, or Firm*—Cullen, Sloman, Cantor, Grauer, Scott & Rutherford

[57] ABSTRACT

A process for cold forming integral spindle-axle tubes includes placing a tubular blank within an open ended die having an extrusion die throat, and pushing the blank through the die throat with a punch. The punch is formed with a ram portion that applies pressure to the blank for moving it axially through the throat. The punch also has an extension closely fitted within the blank so that as the punch pushes the tube axially, the blank is extruded between the die throat and the extension to form a thin wall tube. After the blank is partially extruded, the punch is removed and a second blank is inserted. This second blank is then located between the punch ram portion and the trailing end of the first blank so that further movement of the punch causes the second blank to push the first blank through the die throat. At that time, a second punch extension, of smaller diameter than the first one, is arranged within the throat so that an inwardly thickened ring-like annular section is extruded within the extruded tube, at a distance from the trailing end of the tube. The die movement continues until the first extension is aligned within the throat and the trailing end portion of the extruded tube is completed. Thereafter, the steps are repeated to form additional extruded tubes. Each extruded tube has its trailing end portion and thickened ring section swaged radially inwardly first, until its outside diameter is less than the outside diameter of the tube, and secondly, until the inside diameter of the thinner wall trailing end portion is formed to the same internal diameter as that of the thickened section to thereby provide the integral spindle-axle tube.

6 Claims, 16 Drawing Figures

FIG. 1
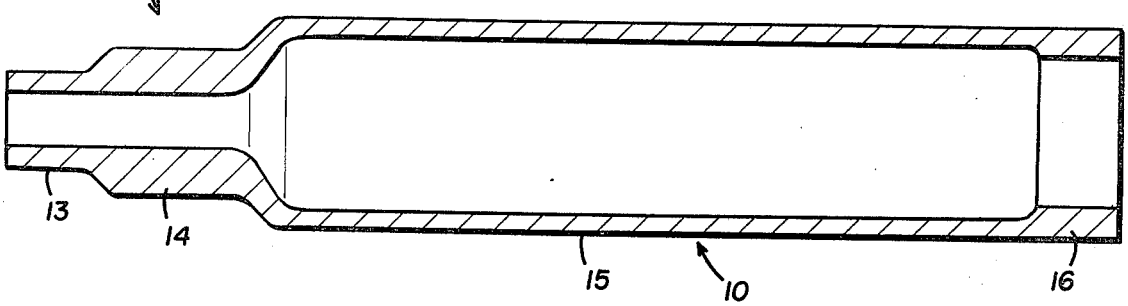
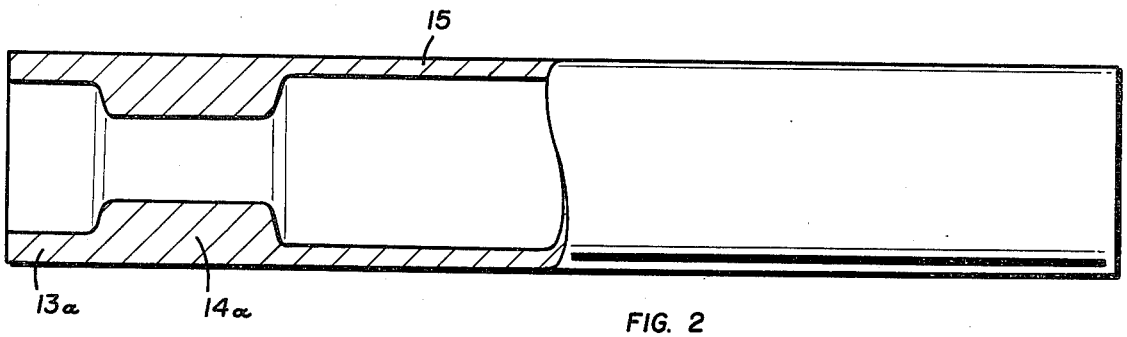
FIG. 2
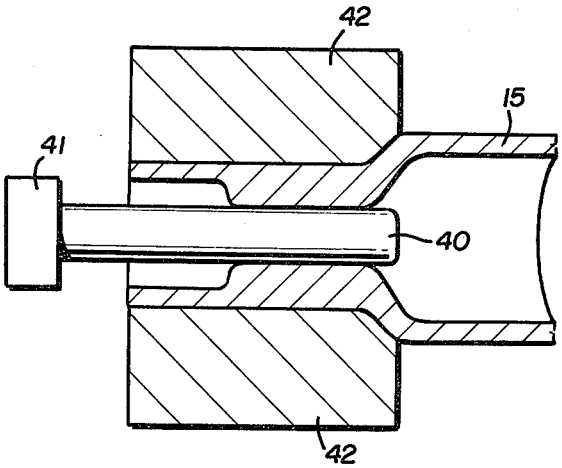
FIG. 3
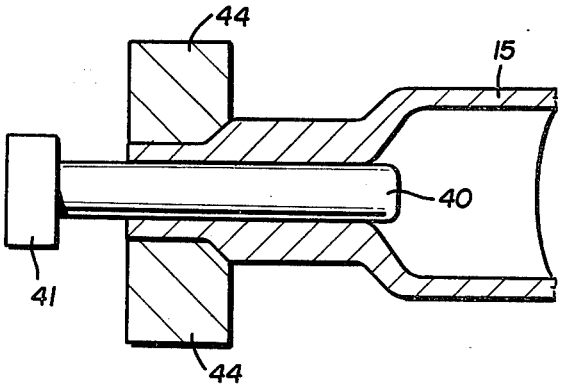
FIG. 4
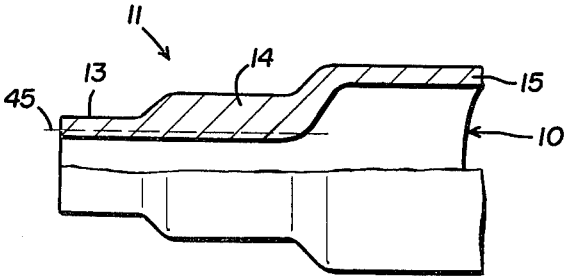
FIG. 5

PROCESS FOR FORMING INTEGRAL SPINDLE-AXLE TUBES

BACKGROUND OF THE INVENTION

This invention relates to a process for forming an integral or one-piece axle tube and spindle. Axle-spindle assemblies of this type are useful as so-called full-float axles for trucks and the like.

Truck axles have been formed by welding together an extruded axle tube and a separate spindle of the type which has a central bore and varying wall thickness along its length. An example of this type of construction is shown in my prior U.S. Pat. No. 3,837,205 issued Sept. 24, 1974 for a "Process for Cold Forming a Metal Tube with an Inwardly Thickened End".

The process disclosed in U.S. Pat. No. 3,837,205 involves extruding a blank through a tubular die using a punch or ram to force the blank through the die. Extensions or steps formed on the punch produce a thickened end portion on the extruded tube. My more recent U.S. Pat. Nos. 4,277,969 issued July 14, 1981 and 4,301,672 issued Nov. 24, 1981 disclose methods by which ring-like or annular thickened portions are formed within the tube during extrusion of the blank by the movement of the punch through the die.

However, in the past, it has not been feasible to form the spindle of the axle integral with the axle tube in an extrusion type of process such as disclosed in my above-mentioned patents. Axles have been made with integral spindles through forging processes which produce a one-piece unit, but the use of forging is relatively expensive and the metallurgical structures produced are not as desirable as those obtained through my above-mentioned extrusion processes.

Thus, the process of this application relates to the forming of an axle tube through, first an extrusion process and thereafter, a simplified step for converting a portion of the extrusion into an integral spindle, thereby eliminating the prior two-piece welded together, construction and the prior forging systems.

SUMMARY OF INVENTION

The invention herein contemplates cold forming or extruding a tubular blank by pushing it through a die throat with a ram type of punch which is formed with a mandrel-like extension or insert that fits within the blank and the die throat. The mandrel extension is formed with multiple steps or sections of successively decreasing diameter. Thus, as the ram punch pushes the blank through the die throat, different diameter mandrel-like sections are aligned within the die throat to produce different wall thicknesses. By properly arranging the punch extensions, a ring-like or annular, radially inwardly extending thickened section is formed within the extruded tube at a short distance from one end of the tube. After the extrusion, the thickened portion with the adjacent tube end portion are swaged to a smaller external diameter than the O.D. of the thin wall tube. Following this, a second swaging step reduces the diameter of the tube end portion to form a substantially uniform diameter bore through it and the thickened portion. Thus, through the swaging operations, the extruded end of the tube is converted into a spindle shape which is integral with the axle.

The tube is formed of a suitable steel material which is selected to provide the necessary strength and metallurgical characteristics. Since the foregoing process is performed cold, that is, at room temperature, the metallurgical structure resulting from the extrusion and swaging steps does not require further heat treating and the metallurgical structure is better than either a machined or forged tube. Further, such heat as may be generated during the extrusion or swaging steps is very low, such as in the order of around 300 degrees F or less than thus, has no adverse effect upon the metallurgical structure of the piece.

An object of this invention is to provide a method for cold forming, out of a single tubular blank, a one-piece or integral spindle-axle tube construction wherein the spindle may have varying wall thicknesses as compared with the relatively thin wall of the axle tube.

Another object of this invention is to produce a relatively light-weight spindle-tube construction which is relatively inexpensive, but with improved metallurgical characteristics as compared to other systems including welding of separate tubes and spindles together.

These and other objects and advantages of this invention will become apparent upon reading the following description of which the attached drawings form a part.

DESCRIPTION OF DRAWINGS

FIG. 1 is a cross-sectional, elevational view of an integral spindle-axle tube of this invention.

FIG. 2 is a partially cross-sectioned, extruded tube prior to forming the spindle portion thereon.

FIG. 3 schematically illustrates one of the swaging steps for forming the spindle, and FIG. 4 schematically illustrates the second swaging step in forming the spindle.

FIG. 5 schematically illustrates the spindle construction and indicates the area where bore machining can be performed.

DETAILED DESCRIPTION

Figure 6:
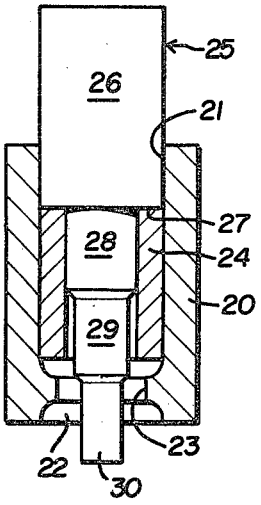
FIGS. 6–13, inclusive, schematically illustrate the successive steps in extruding the axle tube.

FIG. 1 illustrates, in cross-section, a full-float axle tube 10 formed by the process of this invention. The tube which is made of suitable steel, includes an integral spindle 11 formed by an end portion 13 and an adjacent radially inward, thickened annular or ring-like section 14. The tube itself is formed of a relatively thin wall 15, which may be provided with an inwardly thickened opposite end 16.

The outer surfaces of the spindle portion may be suitably machined for carrying bearings or other elements. Likewise, the spindle bore and the tube thickened end 16 may be machined for co-acting with other elements such as bearings, inserts and the like.

Significantly, the entire tube-spindle assembly is made of a one-piece, cold formed extrusion which is swaged to produce the different, desired wall thicknesses. These wall thicknesses are predetermined to provide enough stock for machining purposes where desired, or for increasing strengths or the rigidity of portions of the assembly.

Referring to FIGS. 6–13, the method for forming the tube starts with a tubular shaped die 20 which has an open inlet end 21, an outlet end 22, and a restricted die throat 23. The die may be either vertically or horizontally arranged, depending upon the type of press equipment used with the die. That is, the die is mounted upon the press bed of a conventional press, which is not shown here as it forms no part of the invention.

A blank 24 which is formed of a relatively thick wall, short tube, is placed within the die 20, as illustrated in FIG. 6. Then a punch 25 is inserted within the die.

The punch 25 is provided with an outer ram section 26 which has an annular ram shoulder 27 that engages the free end of the blank. In addition, the punch is provided with a series of extensions or inserts, similar to mandrels. The first extension 28 is relatively large. The second or middle extension 29 is of a smaller diameter and in turn, the third extension 30 is the smallest.

When the press is actuated, the punch moves axially of the die, in the direction of the die throat. This positions the second or middle extension 29 within the die throat. Hence, the slowly moving extension 29 creates an annular space relative to the die throat through which the lead portion of the blank is extruded due to the pressure of the annular shoulder 27. Such lead portion corresponds to the axle tube thickened end 16.

Figure 7:
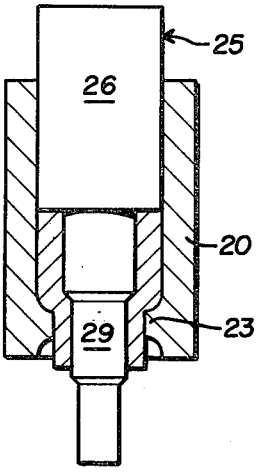
Figure 8:
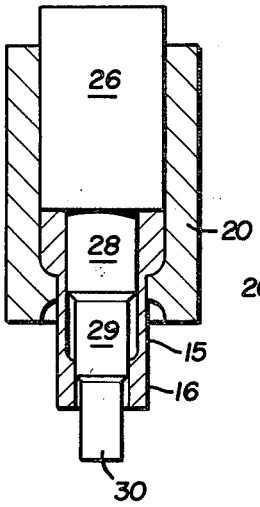

FIG. 7 shows the movement of the ram to produce the lead portion 16. Next, as shown in FIG. 8, continued movement of the punch causes the first or larger extension section 28 to move into the die throat. Further extrusion is between the extension section 28 and the die throat which produces the thin wall 15 of the tube. During the extrusion, the extruded wall moves much more rapidly than does the punch so that the overall tube length is considerably greater than the length of the extension section 28.

Figure 9:
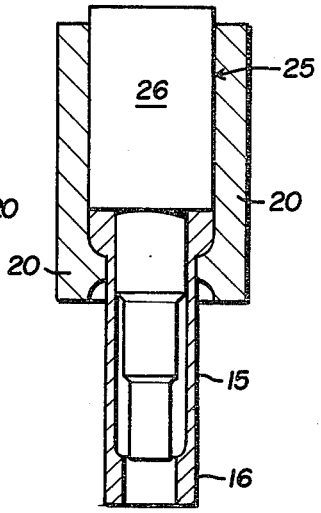
Figure 10:
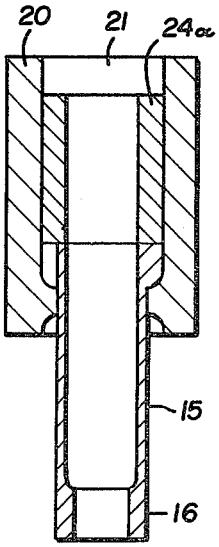

When the punch reaches the point where the thin wall section 11 is completely extruded, the punch is stopped. This leaves an unextruded trailing end portion within the die as shown in FIG. 9. At this point, the punch 25 is removed from the die and from the blank. A second blank **24*a* is inserted within the die as illustrated in FIG. 10**. This second blank, being arranged in end to end contact with the partially extruded first blank beneath it, now functions as if it were a portion of the punch.

Figure 11:
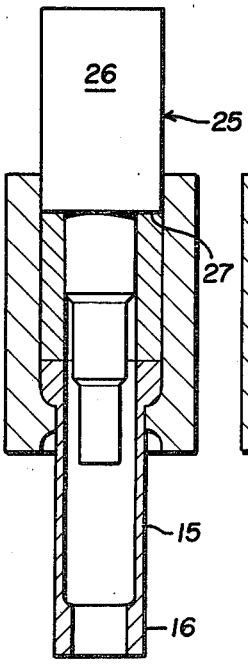

The punch 25 is replaced or reinserted in the die as shown in FIG. 11. Its ram forming annular shoulder 27 contacts the trailing end of the second blank so that movement of the punch now pushes the second blank, which acting like an extension of the ram shoulder 27, pushes against the trailing end of the partially extruded blank beneath it.

Figure 12:
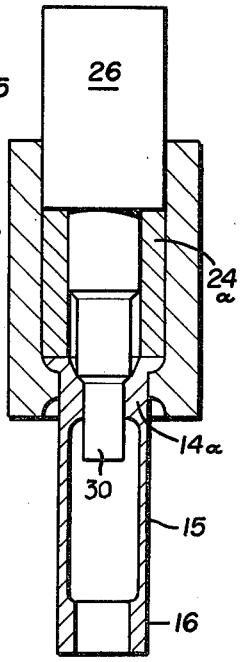

Because of the positioning of the second blank **24*a* within the die, the third or smallest extension section 30 of the punch is located within the die throat, as shown in FIG. 12. Consequently, movement of the punch results in the flow of metal around the third extension section 30 which, acting like a mandrel, produces an inwardly enlarged ring-like formation 14*a***.

Figure 13:
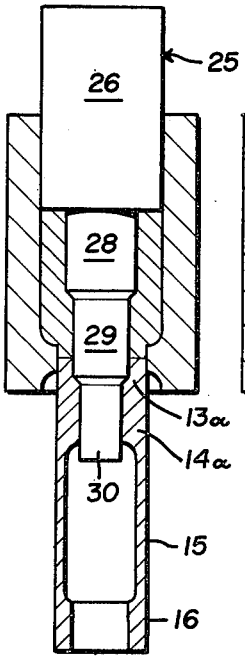

As the punch continues moving, as shown in FIGS. 12 and 13, the thickened portion **14*a* is completed and then further movement results in the middle extension 29 entering the die throat. Because of the positioning of the middle extension, the trailing end portion of the tube forms a wall portion 13*a* which is of the same thickness as the opposite thickened end portion 16**.

Figure 15:
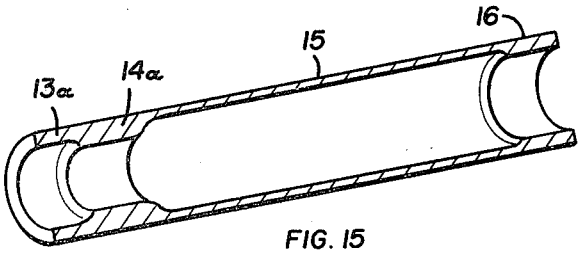
FIG. 15 is a cross-sectional, perspective view, of an extruded tube resulting from the steps illustrated in FIGS. 6–13.

When the extruded tube is completed, it is removed from the die. Its shape is illustrated in FIG. 15. Thereafter, the cycle is repeated over and over again.

Figure 14:
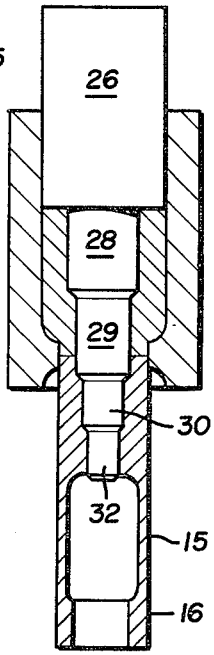
FIG. 14 is a modification, showing the use of a punch having an additional extension or insert section.
Figure 16:
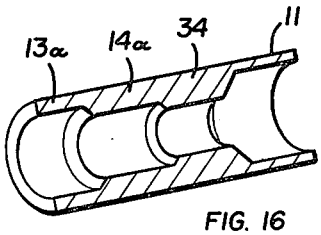
FIG. 16 is a fragmentary, cross-sectional, perspective view of the spindle end portion of an extruded tube produced through the modified punch of FIG. 14.

Although the punch, with its several different diameter extensions, produces different thickness wall sections near the trailing end of the tube, the punch can be modified by using more or less extensions to correspondingly produce more or less different wall thickness areas. For example, as shown in FIG. 14, an additional punch section 32 is provided which, in turn, produces another thicker interior wall section 34 as illustrated in FIG. 16. Thus, the spindle may be provided with more or less stepped sections as required.

The axle tube-spindle formed at the conclusion of the step illustrated in FIG. 13 is illustrated in FIG. 15. The tube and spindle are of a uniform external diameter. Thus, to form the narrower diameter spindle sections, the swaging steps are performed. FIG. 2 illustrates, in an enlarged view, the spindle portion as formed on the tube during the extrusion. As shown in FIG. 3, a mandrel 40 is inserted in the tube end. The mandrel may be supported by an appropriate support which is schematically illustrated as 41. Then, conventional swaging hammers 42 are applied to the exterior, as schematically illustrated in FIG. 3, to reduce the O.D. of the end portion of the tube. Here, the O.D. of the annular thickened section and the thinner wall end portion are the same, but of a smaller diameter than the remainder of the tube.

Next, a second swaging step, using swaging hammers 44, is performed upon the thinner end portion to reduce its O.D. but to produce an I.D. which is the same as the I.D. of the annular thicker section. This provides the spindle bore.

As shown in FIG. 5, the spindle bore may be machined, if necessary, to produce its final accuracy. Sufficient stock may be provided for machining the interior of the bore to its final wall surface as illustrated schematically by the dotted line 45.

If an additional wall thickness portion is desired in the spindle, such as is produced in the extrusion illustrated in FIG. 16, another swaging step can be performed to produce the stepped exterior of the spindle and the single diameter bore.

Although the swaging step is illustrated as utilizing a mandrel to form the spindle bore, the mandrel can be eliminated, in which the case, the bore can be made accurate by machining.

The extrusion steps are preferably conducted cold, that is, at room temperature, as mentioned above. Thus, all that is necessary to extrude the blank, which is precut to size, may be the application of a coating of a lubricant, such as a phosphate to facilitate extrusion. Thus, preparation for the extrusion steps is minimal. Likewise, the swaging steps and the handling of the material during the swaging is minimal so as to reduce time and labor in forming the completed one-piece axle-spindle.

Having fully described an operative embodiment of this invention, I now claim:

1. A process for extruding an integral spindle and axle tube, comprising the steps of:

positioning a relatively short, tubular blank within an open ended, tubular die having an inlet end through which the blank is inserted and an opposite extrusion end formed by an annular, inwardly extending, continuous shoulder forming a die extrusion throat through which the blank is extruded, and with the throat diameter being larger than the inner diameter of the blank;

inserting a punch into the die inlet end, with the punch closely fitted within the die and having an annular shoulder engaged against the free end of the blank, and having a first punch extension closely fitted within the interior wall of the blank, and having a second punch extension of a smaller diameter than the blank interior diameter extended through part of the blank and die throat, and having a third punch extension, which is formed on the punch co-axial with and extending from the second punch extension, but of a smaller diameter than the second punch extension, with the punch shoulder and punch extensions being located co-axially with each other and also with the blank and die throat, and with the second punch extension being located between the first and third punch extensions;

next moving the punch towards the die throat so that the punch shoulder rams the blank towards the die throat, and simultaneously aligns its second punch extension within the die throat to thereby extrude the lead end of the blank through the annular space between said second punch extension and the die throat to thereby form one thickened end of the metal tube;

continuing moving the punch so that the first punch extension aligns with the die throat to thereby extrude the blank through the annular space between the first punch extension and the throat to form a relatively thin wall metal tube middle portion;

then removing the punch from the die, and inserting a second tubular blank within the die in full end to end contact with the trailing end of the partially extruded blank;

reinserting the punch in the die with its punch shoulder engaging the trailing end of the second blank, and with the punch first extension closely fitted within the second blank, so that the punch second extension is aligned with but spaced from the die throat, and the third punch extension is positioned within the die throat;

moving the punch in the direction of the die throat to extrude a portion of the first, partially extruded, blank through the annular space between the die throat and third punch extension to form a relatively thick ring section adjacent the trailing end of the partially extruded blank, and thereafter proceeding with the step of moving the punch so that the second punch extension moves within the die throat and the second blank pushes the remainder of the first, partially extruded, blank through the annular space between the second punch extension and the die throat to form an inwardly thickened end portion on the trailing end of the first blank, and also, simultaneously extrudes an inwardly thickened end portion on the leading end of the second blank;

then removing the extruded first blank and continuing and repeating the cycle on the second and successive blanks;

on each removed extruded blank, swaging radially inwardly, to a uniform outside diameter which is less than the extruded tube external diameter, both the thick ring section and the tube trailing end portion, i.e., the portion located between the thick ring section and the trailing end of the tube;

then swaging radially inwardly only said tube trailing end portion until its internal diameter is about the same as the thick ring section internal diameter and its outside diameter is less than the thick ring section outside diameter, to thereby form an integral spindle and axle tube.

2. A process as defined in claim 1, and including inserting a mandrel within the thick ring section and the trailing end portion prior to swaging for thereby forming the internal diameter upon the mandrel.

3. A process for extruding an integral spindle and axle tube, comprising the steps of:

positioning a relatively short, tubular blank within an open ended, tubular die having an inlet end through which the blank is inserted and an opposite extrusion end forming a die extrusion throat through which the blank is extruded, with the throat diameter being larger than the inner diameter of the blank;

inserting a punch into the die inlet and, with the punch closely fitted within the die and having an annular shoulder engaging against the free end of the blank and having a punch extension closely fitted within the interior wall of the blank;

moving the punch towards the die throat so that the punch shoulder rams the blank towards the die throat, and simultaneously aligns the punch extension within the die throat to thereby extrude the blank through the annular space between said punch extension and the die throat to form a relatively thin wall metal tube;

stopping the punch movement before extruding the trailing end portion of the blank through the die throat;

removing the punch from the die, and inserting a second tubular blank within the die in end to end contact with the trailing end of the partially extruded blank;

inserting a punch in the die with its annular punch shoulder engaging the trailing end of the second blank, and with the punch extension closely fitted within the second blank, and with the punch having a smaller diameter extension-like insert aligned with, but spaced from the die throat;

moving the punch in the direction of the die throat to extrude a portion of the first, partially extruded, blank through the annular space between the die throat and the punch insert to form a relatively thick, inwardly extending, ring section spaced longitudinally inwardly of the trailing end of the partially extruded blank, and thereafter proceeding with the step of moving the punch so that the punch extension moves within the die throat and the second blank pushes the remainder of the first, partially extruded, blank through the annular space between the second punch extension and the die throat to extrude the tube trailing end portion on the trailing end of the first blank, and also, simultaneously extrudes the leading end of the second blank;

then removing the extruded tube formed from the first blank and continuing and repeating the cycle on the second and successive blanks;

swaging the thick ring section and tube trailing end portion of each extruded tube radially inwardly to a uniform outside diameter which is less than the tube external diameter;

then swaging radially inwardly only said tube trailing end portion until its internal diameter is approximately the same as the internal diameter of the thick ring section, and its outside diameter is less than the outside diameter of the thick ring section, to thereby form an integral spindle and axle tube.

4. A process as defined in claim 3, and including inserting a mandrel within the thick ring section and the trailing end portions of each tube prior to swaging the tube for thereby forming the internal diameter therein.

5. A method for forming integral spindles, having more than one wall thickness, and thin wall axle tubes, comprising:

extruding a uniform external diameter thin wall elongated tube of substantially uniform wall thickness, with an annular radially inwardly extending thickened section located near, but longitudinally spaced a distance from, one end of the tube;

swaging radially inwardly, to a uniform outside diameter which is less than the tube external diameter, both the thickened section and the tube end portion, i.e., the portion located between the thickened section and the tube end;

then swaging radially inwardly only said tube end portion until its internal diameter is about the same as the thickened section internal diameter and its outside diameter is less than the thickened section outside diameter, to thereby form an integral spindle and axle tube.

6. A method as defined in claim 5, and including the step of inserting a mandrel within the thickened section and tube end portion at least prior to the second swaging step, for forming a uniform internal diameter therein.

* * * * *